US006283021B1

(12) United States Patent
Watanabe et al.

(10) Patent No.: US 6,283,021 B1
(45) Date of Patent: Sep. 4, 2001

(54) STENCIL MAKING AND ATTACHING METHOD OF PRINTING DEVICE

(75) Inventors: Hitoshi Watanabe; Kaoru Kimura; Masakazu Miyata, all of Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/659,543

(22) Filed: Sep. 11, 2000

(30) Foreign Application Priority Data

Sep. 17, 1999 (JP) ..... 11-264483

(51) Int. Cl.[7] ..... B05C 17/06

(52) U.S. Cl. ..... 101/127; 101/116; 101/118; 101/128.1; 101/128.4

(58) Field of Search ..... 101/128.1, 128.4, 101/116, 122, 118, 127

(56) References Cited

U.S. PATENT DOCUMENTS 3,749,009 * 7/1973 Suzuki ..... 101/127
5,558,019 * 9/1996 Kawai et al. ..... 101/128.4
5,575,205 * 11/1996 Iida ..... 101/128.4
5,671,669 * 9/1997 Okuda et al. ..... 101/128.1
5,970,868 * 10/1999 Kimura et al. ..... 101/128.4

FOREIGN PATENT DOCUMENTS 0 652 112 A1 5/1995 (EP) .
0 888 897 A1 1/1999 (EP) .
02 098480 4/1990 (JP) .

* cited by examiner

*Primary Examiner*—Kimberly L. Asher
*Assistant Examiner*—Marvin P. Crenshaw
(74) *Attorney, Agent, or Firm*—Nath & Associates PLLC; Gary M. Nath; Marvin C. Berkowitz

(57) ABSTRACT

According to the stencil making and attaching method of a printing device of the present invention, independent of variations in the detection of the stencil sheet set position detection sensor and variations in the clamped state due to curled stencil sheet, etc., it is possible to always set the image-formation start position of the stencil sheet at a regular position with respect to the drum rotation position, and consequently to improve the positional precision of the printing operation.

5 Claims, 14 Drawing Sheets

STENCIL MAKING AND ATTACHING METHOD OF PRINTING DEVICE

BACKGROUND OF THE INVENTION

1. Field of the Invention

The present invention relates to a printing device which carries out a stencil-making process in which an image is written on a stencil sheet by using a printing head and a stencil-attaching process in which the stencil sheet is wrapped around a drum, prior to a printing operation, and more specifically, relates to a stencil making and attaching method thereof.

2. Description of the Related Art

An explanation will be given of conventional stencil making and attaching methods in a printing device of this type.

As illustrated in FIG. 1, an elongated stencil sheet 100, is housed in an sheet housing section (not shown), and on the downstream side of the sheet conveying path, a thermal print head 101, which is a printing head for forming pores corresponding to an image in the stencil sheet 100, and a platen roller 102, which is pressed onto the thermal print head 101 with the stencil sheet 100 interposed in between, are installed.

On the downstream side of the platen roller 102 in the stencil sheet conveying path, a pair of first convey rollers 103 are placed in a virtually press-contact state, and the platen roller 102 and one of the first convey rollers 103 are designed so as to be rotated in synchronism with the platen roller 102 by the rotating force of a stencil motor, not shown.

On the downstream side of the pair of first convey rollers 103 in the stencil sheet conveying path, a pair of second convey rollers 104 are placed in a virtually press-contact state, and on the further downstream side of the pair of second convey rollers 104 in the stencil sheet conveying path, a pair of third convey rollers 105 are placed in a virtually press-contact state. The respective ones of the second convey rollers 104 and the third convey rollers 105 are designed to be rotated by the rotating force of a convey motor, not shown, in synchronism with each other.

Moreover, a sheet temporary stacker section 106 is installed at a lower position between the pair of first convey rollers 103 and the pair of second convey rollers 104. A stencil sheet cutter section 107 is installed between the pair of second convey rollers 104 and the pair of third convey rollers 105, and a stencil sheet set position detection sensor 108 is placed on the downstream side of the pair of third convey rollers 105 in the stencil sheet conveying path.

The stencil sheet set position detection sensor 108 is constituted by a reflection-type photo-sensor, and when the leading end of the stencil sheet 100 has been conveyed to a position below this, it detects the existence thereof.

Furthermore, on the downstream side of the stencil sheet set position detection sensor 108, a drum 109 is installed so as to be freely rotated, and this drum 109 is arranged to be rotated by the rotating force of a drum motor, not shown. A stencil sheet clamp section 110 is installed on the periphery of the drum 109, and the leading end of the stencil sheet 100 is clamped by this stencil sheet clamping section 110.

Next, in the above-mentioned arrangement, referring to FIGS. 1 through 5, an explanation will be given of stencil making and attaching methods of the stencil sheet 100. Here, suppose that the leading end of the stencil sheet 100 is only inserted between the thermal print head 101 and the platen roller 102 and that the drum 109 is positioned at a drum reference position at which the drum 109 is allowed to carry out the stencil sheet clamping process.

In this state, the stencil motor and the convey motor are both driven so that the platen roller 102, the first convey rollers 103, the second convey rollers 104 and the third convey rollers 105 are rotated so that the stencil sheet 100 is conveyed to the drum side. Here, when the leading edge of the stencil sheet 100 has reached the position below the stencil sheet set position detection sensor 108, the stencil sheet set position detection sensor 108 detects this, with the result that the conveyance of the stencil sheet 100 is stopped. In this case, the leading edge of the stencil sheet 100 is positioned at a stencil sheet setting position as shown in FIG. 1.

Next, as shown in FIG. 2, the stencil motor is driven to rotate the platen roller 102 and the first convey roller 103 so that, while the stencil sheet 100 is being conveyed, pores corresponding to a desired image are formed in the stencil sheet 100 through a heat-sensitive process by the thermal print head 101, thereby carrying out a stencil making process. The stencil sheet 100 which has been subjected to the stencil making process is temporarily housed in a temporary stacker section 106.

Next, as shown in FIG. 3, the convey motor is driven to rotate the second convey roller 104 and the third convey roller 105 so that the stencil sheet 100 is conveyed to the drum side by a predetermined amount. Then, this convey process by the predetermined amount allows the leading edge of the stencil sheet 100 to reach the position of the stencil sheet clamp section 110 of the drum 109, with the result that the stencil sheet clamp section 110 clamps the leading edge of the stencil sheet 100.

Successively, as shown in FIG. 4, the drum motor is driven to rotate the drum 109 in the arrow direction so that the stencil sheet 100 is gradually wrapped around the periphery of the drum 109. Further, as shown in FIG. 5, when this has been wrapped to a stencil sheet cut position, the rotation of the drum 109 is temporarily stopped so that the stencil sheet 100 is cut by the stencil sheet cutter section 107. After the cutting process, the drum motor is again driven so that the drum 109 is rotated so that the stencil sheet 100 is completely wrapped around the periphery of the drum 109, thereby completing the stencil attaching process. After completion of the stencil attaching process, a sheet of printing paper (not shown) is supplied to the drum 109 in synchronism with the rotation of the drum 109, and the sheet of printing paper is conveyed while being pressed onto the stencil sheet 100 wrapped around the drum 109; thus, during this conveying process, ink is transferred onto the sheet of printing paper through the pores of the stencil sheet 100, thereby carrying out a printing process.

In the above-mentioned stencil making and attaching method, as shown in FIG. 6, a position corresponding to a distance L1 from the leading edge of the stencil sheet 100 to the thermal print head 101 is defined as the image-formation start position, and as shown in FIG. 7(A), the leading edge of the stencil sheet 100 that has been subjected to the image formation is clamped at a clamp reference position of the drum 109 so that the image-formation start position is set at a fixed position. Then, a sheet of printing paper is conveyed in synchronism with the rotation of the drum 109 so that an image is always formed at a predetermined position on the sheet of printing paper.

However, the distance L1 from the leading edge of the stencil sheet 100 to the image-formation start position fails to provide an accurate length in the event of curing, etc. in the stencil sheet 100 as indicated by a hypothetical line in FIG. 7 or in the event of variations in the detection of the stencil sheet set position detection sensor 108. Moreover, with respect to the clamp position of the drum 109, clamping is not made at an accurate position when a slip, etc. of the stencil sheet 100 occurs with respect to the second convey roller 104 and the third convey roller 105, as shown in FIGS. 7(B) and 7(C). In this manner, when the image-formation position of the stencil sheet 100 and the clamp position with respect to the drum 109 are not accurate, the image-formation position of the stencil sheet 100 with respect to the drum 109 is offset from the regular position, with the result that an offset occurs in the print position on a sheet of printing paper, causing degradation in the positional precision in the printing process.

SUMMARY OF THE INVENTION

The present invention has been devised to solve the above-mentioned problems, and its object is to provide a stencil making and attaching method of a printing device which can always maintain the image-formation start position of a stencil sheet at a regular position with respect to the rotation position of a drum independent of curing, etc. of the stencil sheet, variations in the detection of a stencil sheet set position detection sensor and a clamped state, and consequently improve the positional precision of the printing process.

One of the feature of the present invention is that, in a printing device having a printing head for writing an image in a stencil sheet, a platen roller that is made in contact with the printing head with the stencil sheet interposed in between, a drum having a stencil sheet clamp section for clamping the leading edge of the stencil sheet, the drum being placed on the downstream side of the printing head and the platen roller in the stencil sheet convey path and drum rotation position detection unit for detecting the rotation position of the drum, the method includes the steps of: rotating the platen roller in the forward direction so as to convey the stencil sheet toward the drum side; clamping the leading edge of the stencil sheet thus conveyed by the stencil sheet clamp section; after the clamp process, rotating the platen roller in the forward direction, while rotating the drum in the forward direction so as to wrap the stencil sheet around the drum so as to be attached thereon; and during this attaching process, detecting the rotation position of the drum by using the drum rotation position detection unit so that the printing head is allowed to perforate the stencil sheet, thereby carrying out a stencil making process.

In the above-mentioned stencil attaching method of a printing device, after the leading edge of the stencil sheet has been clamped by the stencil sheet clamp section of the drum, an image writing operation is carried out on the stencil sheet based upon the rotation position of the drum.

It is preferable to carry out a stencil sheet tension applying process for applying a tension to the stencil sheet clamped by the clamp section between the clamp process and the simultaneous stencil making and attaching processes.

In accordance with this stencil making and attaching method of a printing device, it is possible to eliminate slacking of the stencil sheet, and also to eliminate variations in the amounts of clamp in a lateral direction of the stencil sheet.

Also, it is preferable that in the stencil sheet tension applying process, the platen roller is rotated in the reverse direction that is opposite to the forward direction so that the stencil sheet is pulled in a direction so as to be separated from the drum.

In accordance with this stencil making and attaching method of a printing device, the stencil sheet on the printing head side is pulled toward a direction reversed to the conveying direction.

And, it is desirable that in the stencil sheet tension applying process, the drum is rotated in the forward direction so that the stencil sheet is pulled in a direction so as to wrap the stencil sheet around the drum.

In accordance with this stencil making and attaching method of a printing device, the stencil sheet on the leading edge side is pulled in the conveying direction.

And also it is preferable that in the stencil sheet tension applying process, the rotation operation of the platen roller and the rotation operation of the drum are carried out in a combined manner.

In accordance with this stencil making and attaching method of a printing device, a tension is applied to the stencil sheet by the rotation operation of the platen roller and the rotation operation of the drum.

Other and further objects and features of the present invention will become obvious upon understanding of the illustrative embodiments about to be described in connection with the accompanying drawings or will be indicated in the appended claims, and various advantages not referred to herein will occur to one skilled in the art upon employing of the invention in practice.

DETAILED DESCRIPTION OF THE PREFERRED EMBODIMENTS

Figure 1:
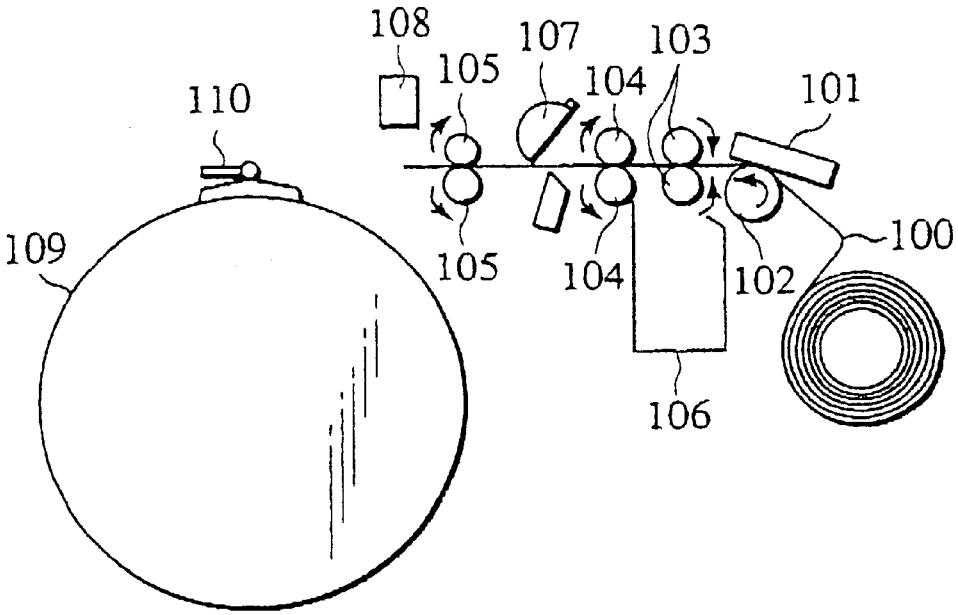
FIG.1 PRIOR ART
FIG. 1 is a schematic structural diagram showing one process of a conventional stencil making and attaching operation.
Figure 2:
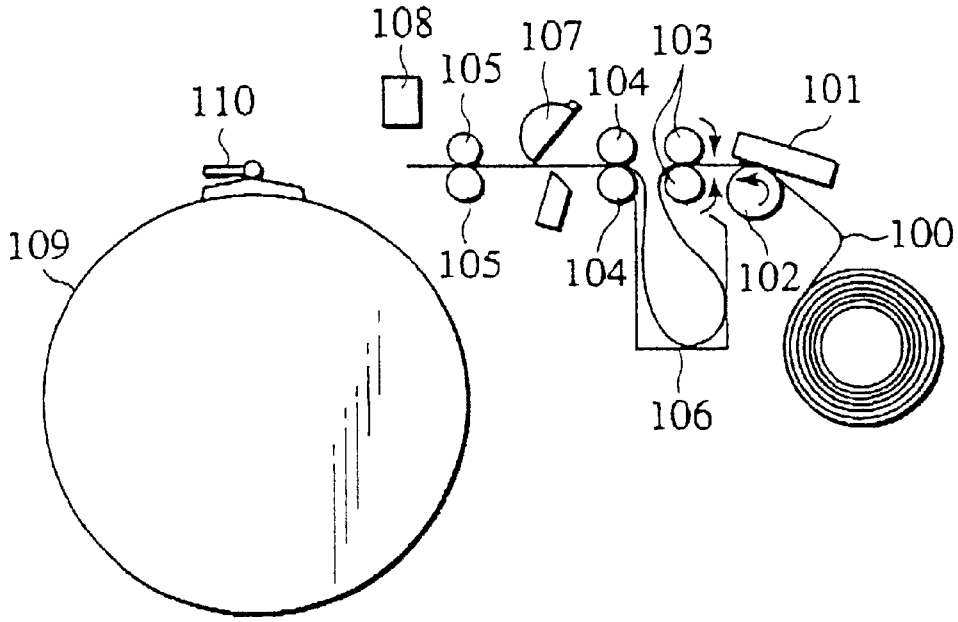
FIG.2 PRIOR ART
FIG. 2 is a schematic structural diagram showing one process of a conventional stencil making and attaching operation.
Figure 3:
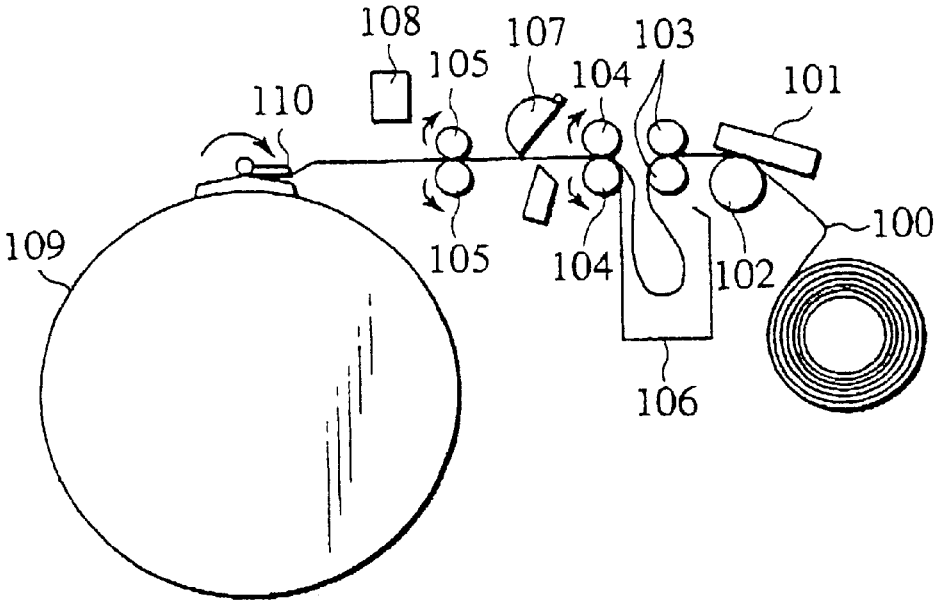
FIG.3 PRIOR ART
FIG. 3 is a schematic structural diagram showing one process of a conventional stencil making and attaching operation.
Figure 4:
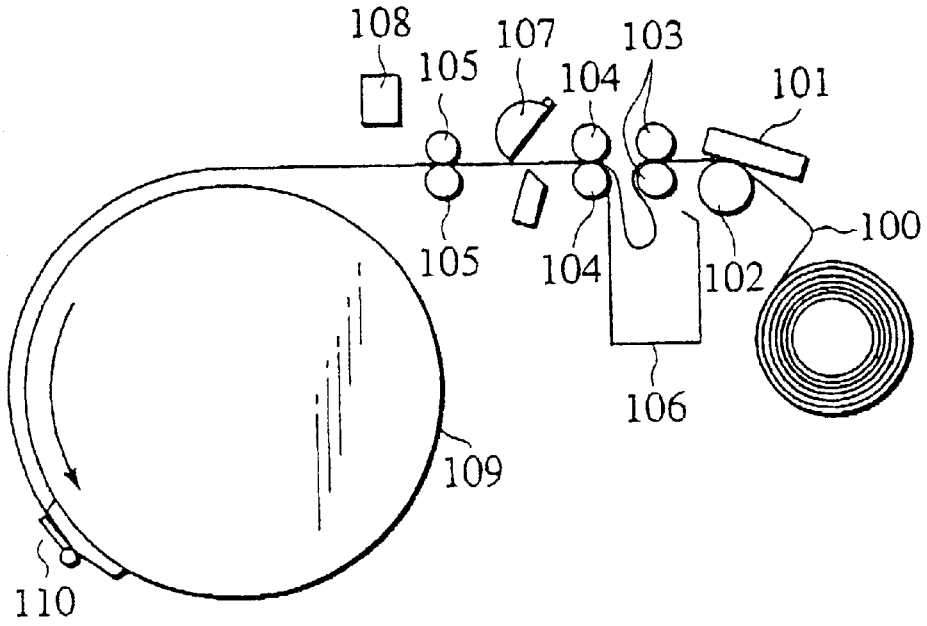
FIG.4 PRIOR ART
FIG. 4 is a schematic structural diagram showing one process of a conventional stencil making and attaching operation.
Figure 5:
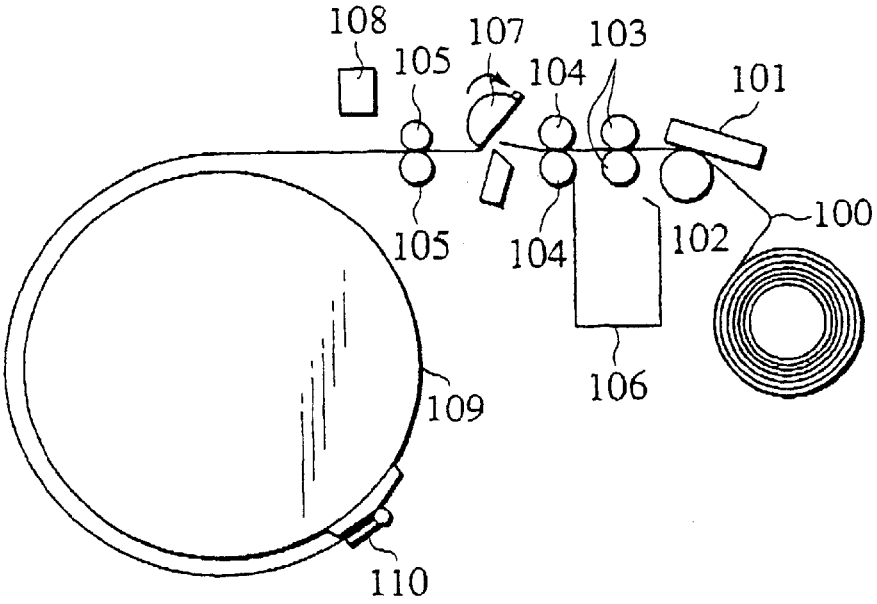
FIG.5 PRIOR ART
FIG. 5 is a schematic structural diagram showing one process of a conventional stencil making and attaching operation.
Figure 6:
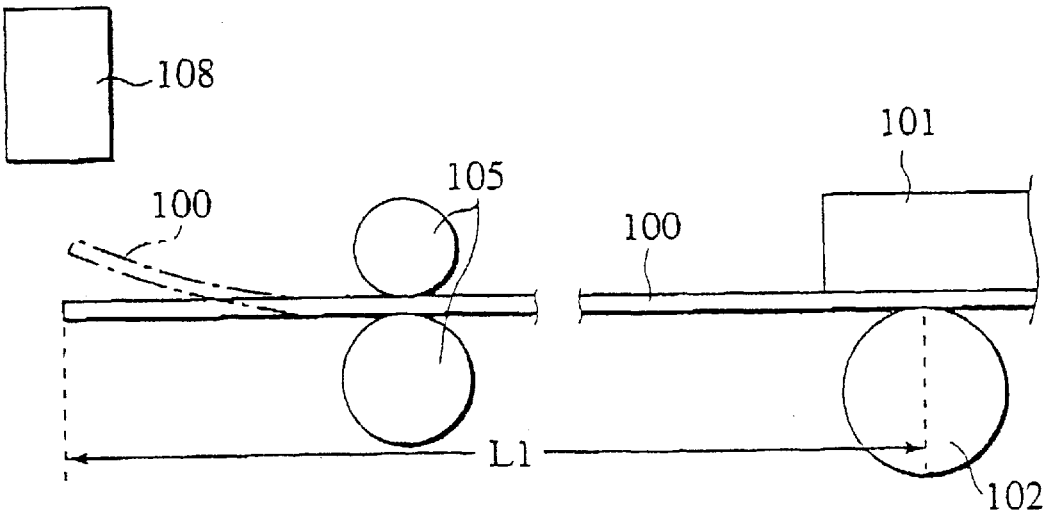
FIG.6 PRIOR ART
FIG. 6 is a diagram showing an image-formation start position of stencil sheet.
Figure 7A:
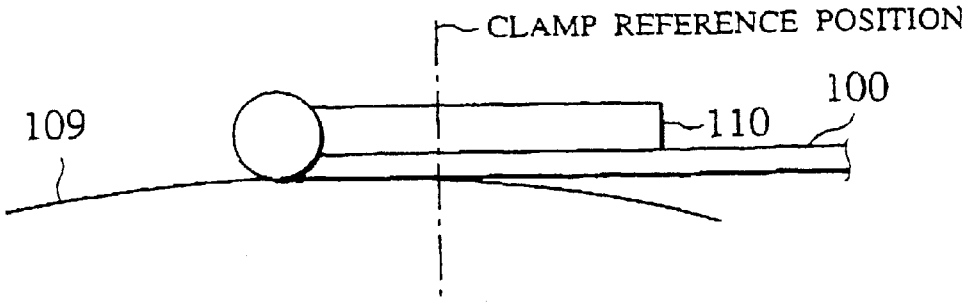
FIG.7A PRIOR ART
FIG. 7(A) is a diagram showing a clamped state at an appropriate position.
Figure 7B:
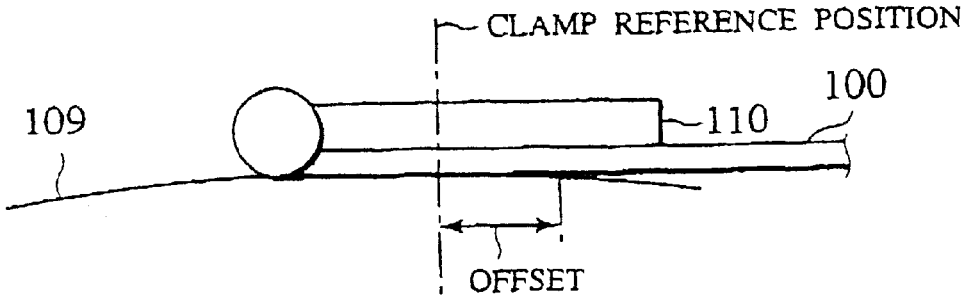
FIG.7B PRIOR ART
FIGS. 7(B) and 7(C) are diagrams that respectively show clamped states at inappropriate positions.
Figure 7C:
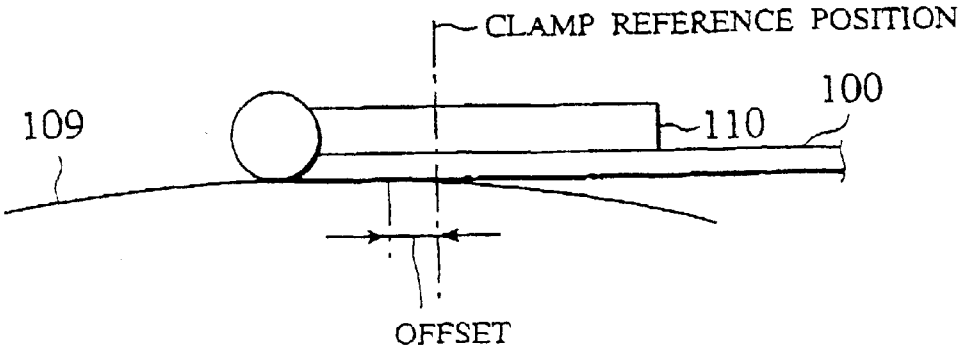
FIG.7C PRIOR ART

Various embodiments of the present invention will be described with reference to the accompanying drawings. It is to be noted that the same or similar reference numerals are applied to the same or similar parts and elements throughout the drawings, and the description of the same or similar parts and elements will be omitted or simplified.

First Embodiment

FIGS. 8 through 20 show a first embodiment of the present invention, and FIG. 1 is a structural diagram showing an essential portion of a stencil printing device.

Figure 8:
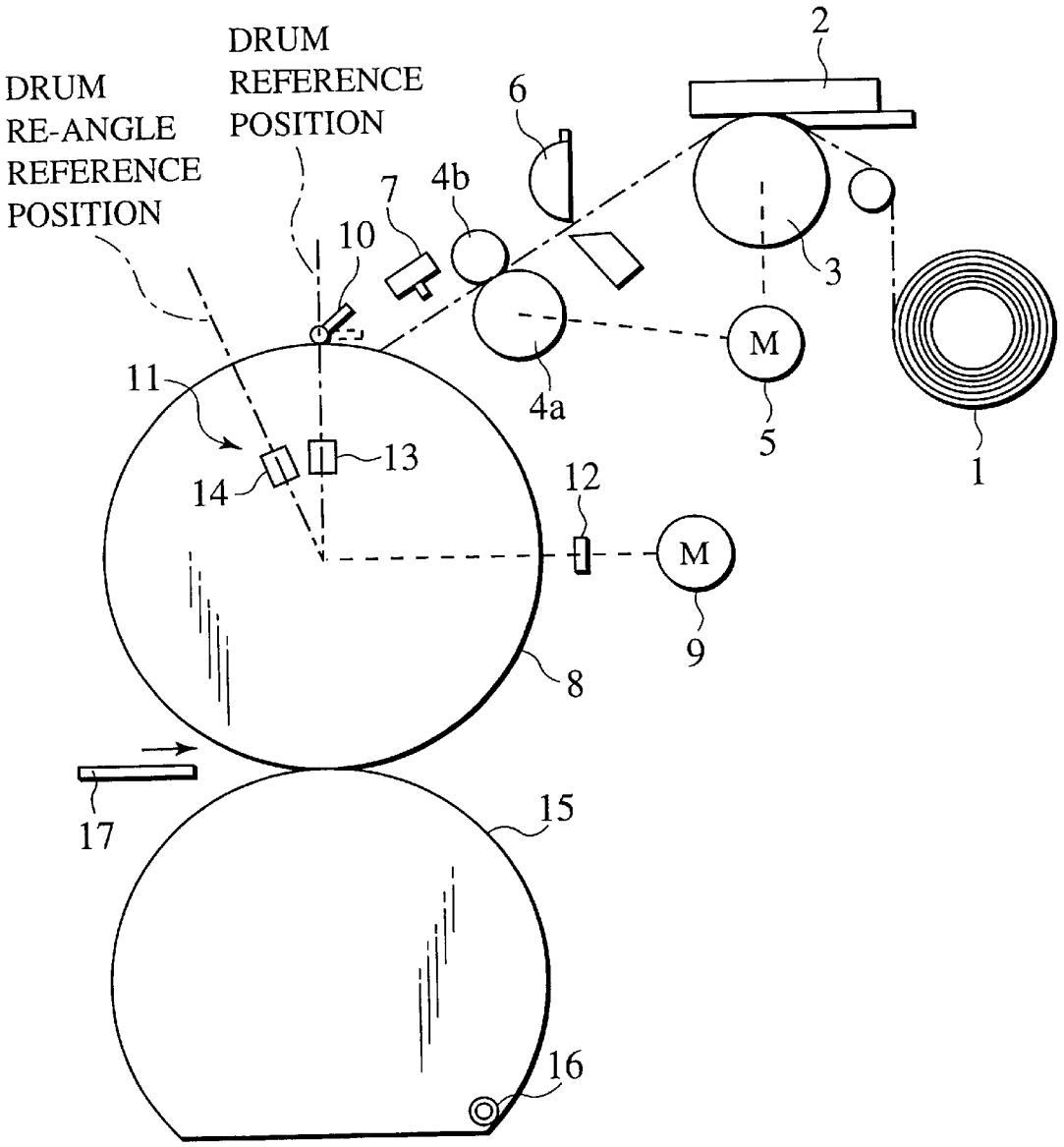
FIG. 8, which shows a first embodiment of the present invention, is a structural diagram of an essential part of a stencil printing device.

In FIG. 8, an elongated stencil sheet 1, is housed in a stencil sheet housing section (not shown), and on the downstream side of the stencil sheet convey path, a thermal print head 2, which is a printing head for forming pores corresponding to an image in the stencil sheet 1, and a platen roller 3, which is pressed onto the thermal print head 2 with the stencil sheet 1 interposed in between, are installed. On the downstream side of the platen roller 3 in the stencil sheet convey path, a pair of convey rollers 4*a* and 4*b* are placed in a virtually press-contact state, and the platen roller 3 and one of the convey rollers 4*a* and 4*b* are designed so as to be rotated in synchronism with each other by the rotating force of a stencil motor 5. The stencil motor 5 is constituted by a stepping motor.

Between the thermal print head 2 as well as platen roller 3 and the pair of convey rollers 4*a* and 4*b*, a stencil sheet cutter section 6 is installed, and this stencil sheet cutter section 6 is used for cutting the stencil sheet 1. Moreover, on the downstream side in the stencil sheet convey path of the pair of convey rollers 4*a* and 4*b*, a stencil sheet set position detection sensor 7 is installed. The stencil sheet set position detection sensor 7 is constituted by a reflection-type photosensor, and used for detecting the leading edge of the stencil sheet 1 when it is conveyed to a position below the sensor.

Moreover, on the downstream side of the stencil sheet set position detection sensor 7, a printing drum 8, which has a drum shape, is installed so as to be freely rotated, and the printing drum 8 is rotated by the rotation force of a drum motor 9. The drum motor 9 is constituted by a stepping motor. On the periphery of the printing drum 8, a stencil sheet clamp section 10 is installed, and the leading edge of the stencil sheet 1 is clamped by the stencil sheet clamp section 10, and is also released from the clamped state.

The drum rotation position detection unit 11 is provided with an encoder 12 for detecting the rotation of the drum motor 9, and for outputting a pulse for each predetermined rotation angle, a drum reference position detection sensor 13 for detecting the drum reference position of the printing drum 8 and a drum re-angle reference position detection sensor 14 for detecting a drum re-angle reference position that is a position rotated from the drum reference position of the printing drum 8 by an angle θ in the forward direction; thus, the rotation position of the printing drum 8 is detected by these detection outputs. These detection output processes are executed by a control section 20, which will be described below.

Moreover, a pressure drum 15 is installed so as to be freely rotated, below the printing drum 8 virtually in the proximity of the printing drum 8, and this pressure drum 15 is rotated in synchronism with the rotation of the printing drum 8 during the printing process. A paper clamp section 16 is placed on the periphery of the pressure drum 15, and the leading edge of printing paper 17 is clamped by the paper clamp section 16. The printing paper 17 is conveyed from a paper-feed section, not shown, to the gap between the printing drum 8 and the pressure drum 15 in synchronism with the rotations of the printing drum 8 and the pressure drum 15. Then, the printing paper 17, thus conveyed, is further conveyed while being pressed onto the stencil sheet 1 by the rotations of the printing drum 8 and the pressure drum 15. This printing pressure is exerted because an inner pressing roller (not shown) is installed inside the printing drum 8 so as to press the peripheral screen of the printing drum 8. In other words, an inner press system is adopted.

Figure 9:
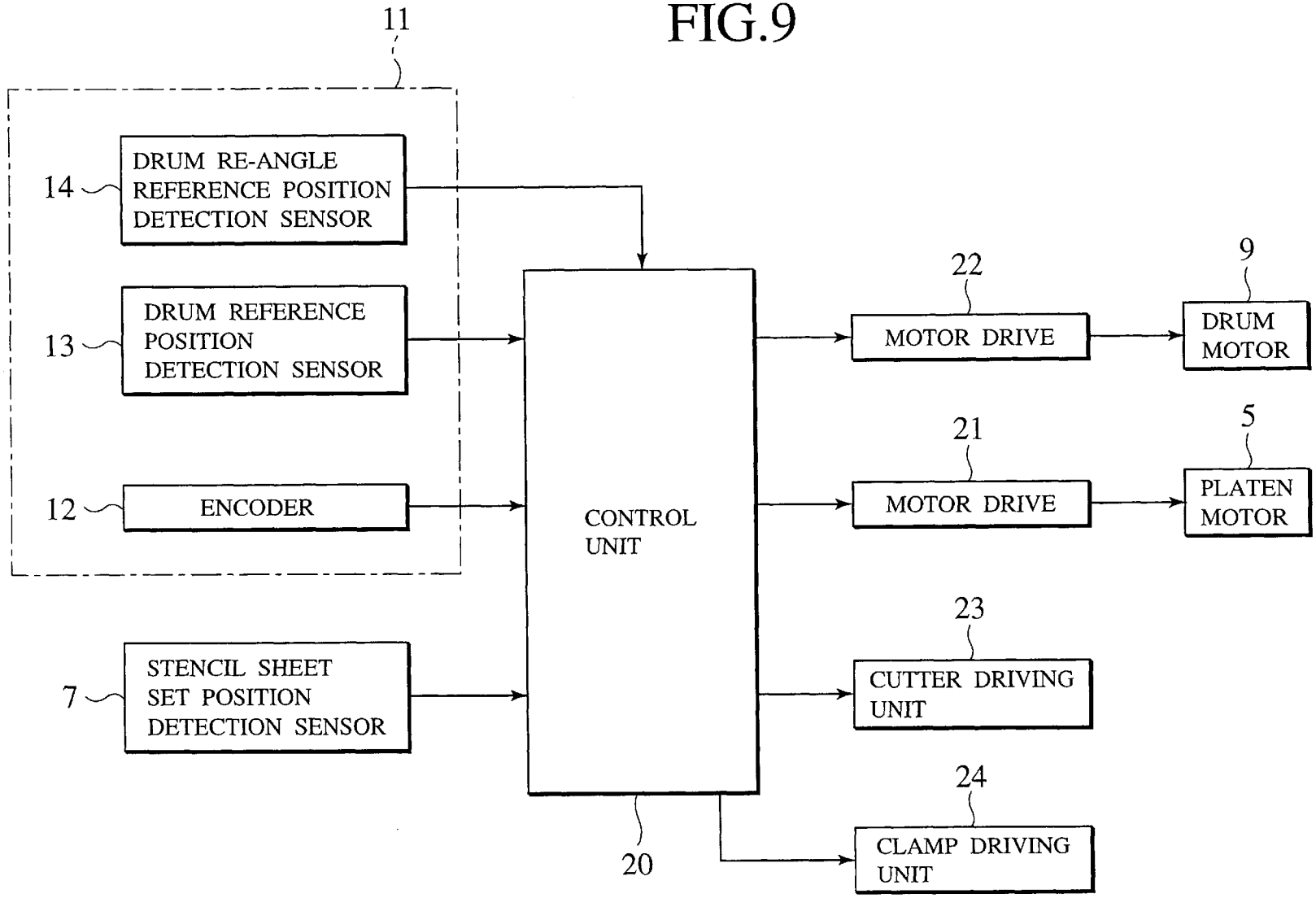
FIG. 9, which shows the first embodiment of the present invention, is a block diagram of a control circuit for stencil making and attaching processes.
Figure 10:
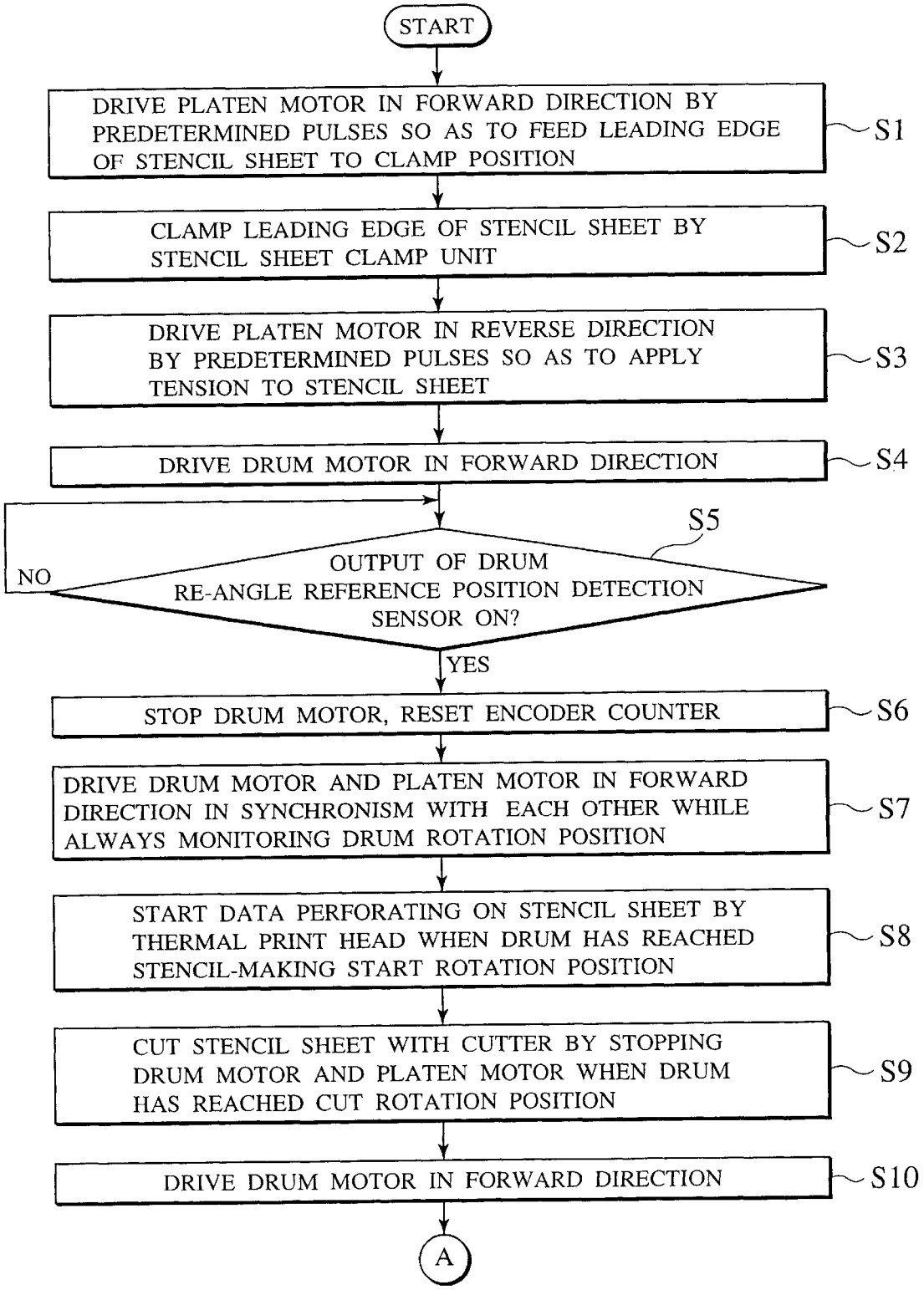
FIG. 10, which shows the first embodiment of the present invention, is a flow chart showing the former half a flow chart of the stencil making and attaching processes.
Figure 11:
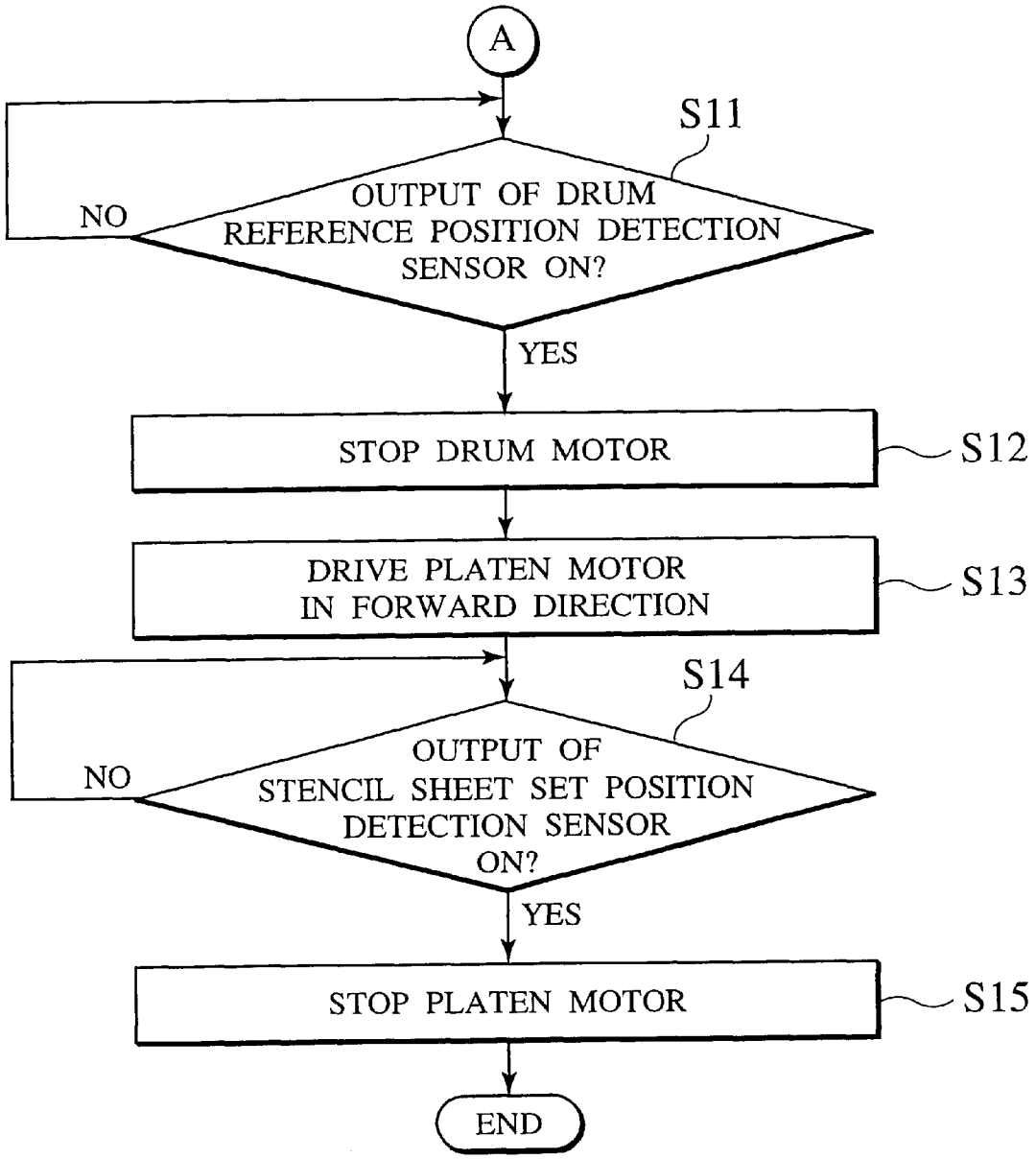
FIG. 11, which shows the first embodiment of the present invention, is a flow chart showing the latter half a flow chart of the stencil making and attaching processes.

FIG. 9 is a block diagram showing a control circuit or stencil making and attaching processes, FIG. 10 is a flow chart showing the former half of the stencil making and attaching processes, and FIG. 11 is a flow chart showing the latter half of the stencil making and attaching processes.

In FIG. 9, the respective detection outputs of the encoder 12, the drum reference position detection sensor 13, the drum re-angle reference position detection sensor 14 and the stencil sheet set position detection sensor 7 are outputted to the control section 20. The control section 20 controls the rotations of the stencil motor 5 and the drum motor 9 through the respective motor drive circuits 21 and 22, and also controls driving operations of the cutter driving section 23 of the stencil sheet cutter section 6 and the clamp driving section 24 of the stencil sheet clamp section 10. Then, at the time of stencil making and attaching operations, the control section 20 respectively controls the stencil motor 5, the drum motor 9, the cutter driving section 23 and the clamp driving section 24 so as to execute processes shown in the flow charts of FIGS. 10 and 11. The following description will discuss the specific contents of the controlling operations.

Figure 12:
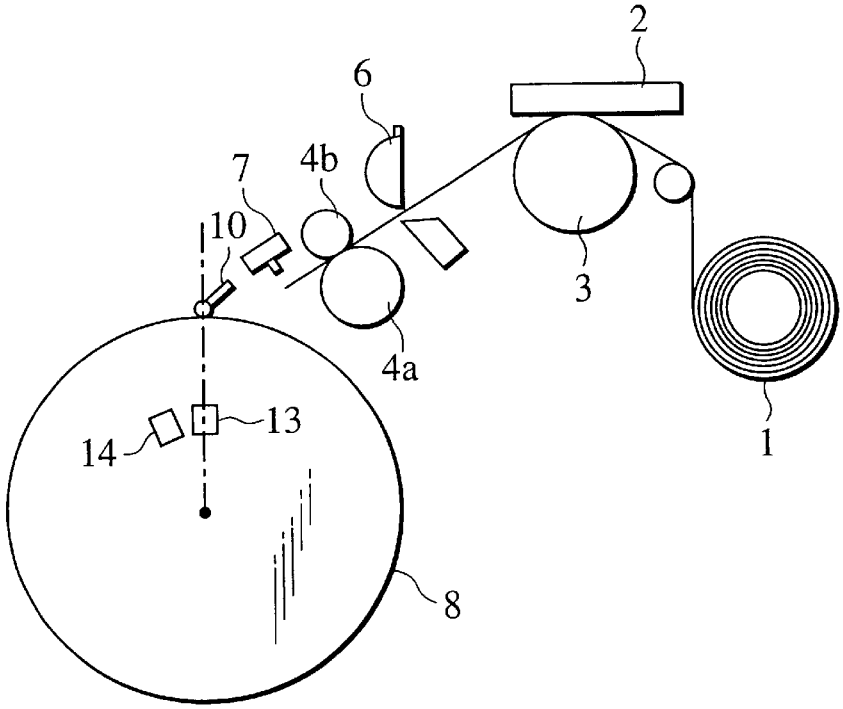
FIG. 12, which shows the first embodiment of the present invention, is a structural diagram showing one process of the stencil making and attaching processes.

FIGS. 12 through 18 are schematic side views showing the respective processes of the stencil making and attaching operations, and referring to FIGS. 12 to 18 and the operational flow charts of FIGS. 10 and 11, an explanation will be given of the stencil making and attaching methods of the stencil sheet 1. As illustrated in FIG. 12, suppose that the leading edge of the stencil sheet 1 is located at a position below the stencil sheet set position detection sensor 7, and that the printing drum 8 is located at the drum reference position at which it is allowed to carry out the stencil sheet clamping operation.

Figure 13:
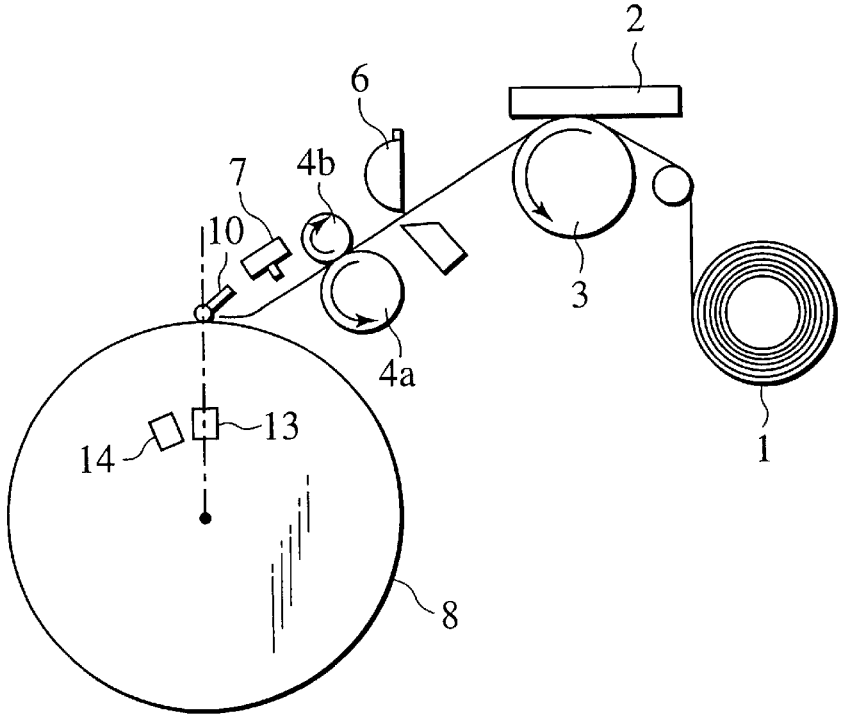
FIG. 13, which shows the first embodiment of the present invention, is a structural diagram showing one process of the stencil making and attaching processes.

In this state, the stencil motor 5 is driven in the forward direction by an extent corresponding to predetermined pulses. Then, the platen roller 3 and the first convey rollers 4*a* and 4*b* are rotated so that the stencil sheet 1 is conveyed to the printing drum side, and as shown in FIG. 13, the leading edge of the stencil sheet 1 is fed to the position of the stencil sheet clamp section 10 (step S1).

Figure 14:
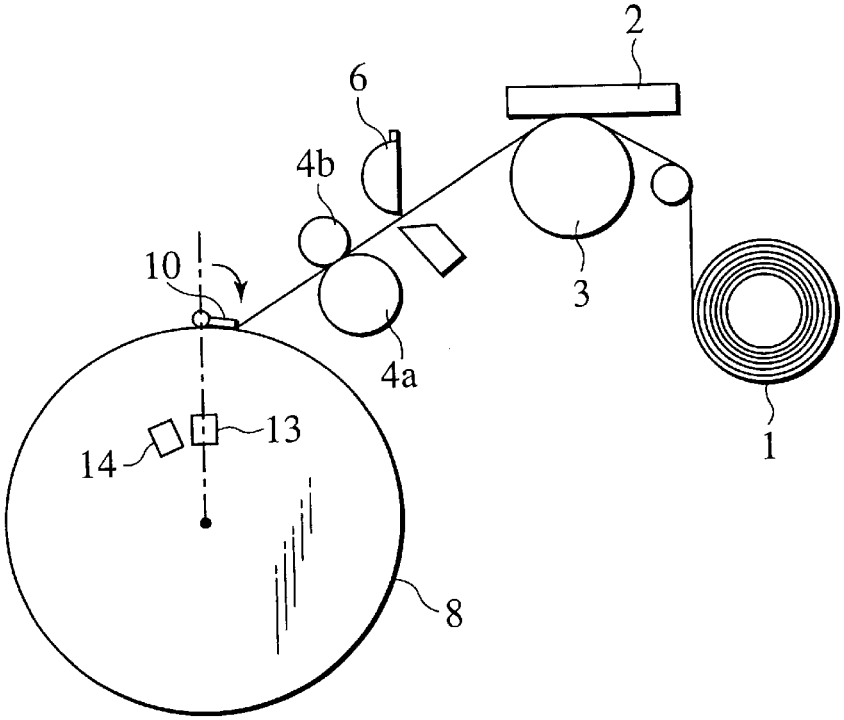
FIG. 14, which shows the first embodiment of the present invention, is a structural diagram showing one process of the stencil making and attaching processes.
Figure 15:
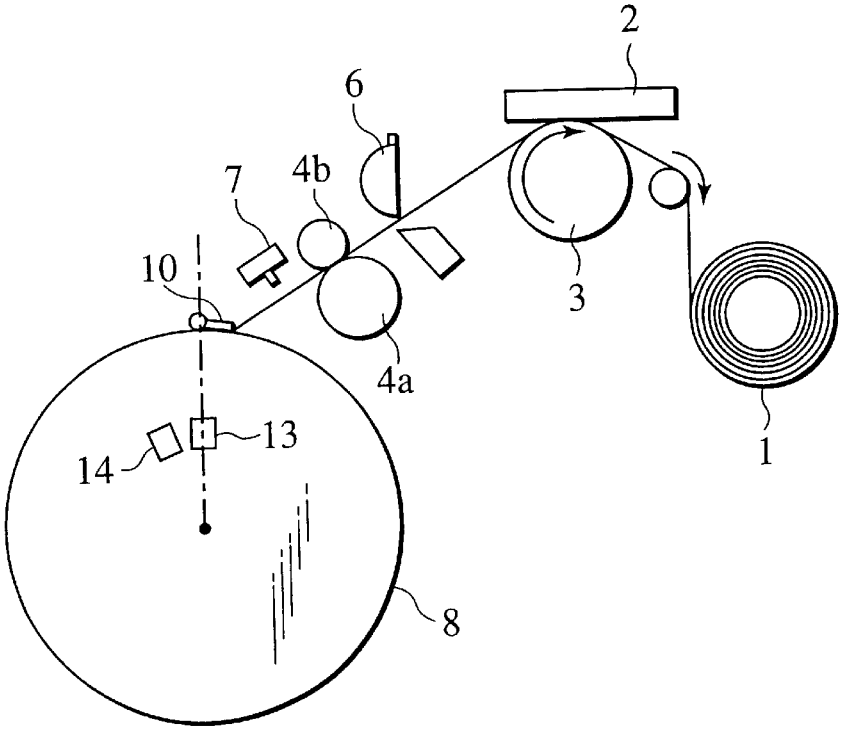
FIG. 15, which shows the first embodiment of the present invention, is a structural diagram showing one process of the stencil making and attaching processes.

Next, as shown in FIG. 14, the clamp driving section 24 is driven so that the leading edge of the stencil sheet 1 is clamped by the stencil sheet clamp section 10 (step S2). Next, as shown in FIG. 15, the stencil motor 5 is driven in the reverse direction that is a direction opposite to the forward direction by an extent corresponding to predetermined pulses. Then, the platen roller 3 and the pair of convey rollers 4*a* and 4*b* are rotated so that the stencil sheet 1 is conveyed in a direction so as to be separated from the drum 8; thus, a tension is applied to the stencil sheet 1 (step S3).

Figure 16:
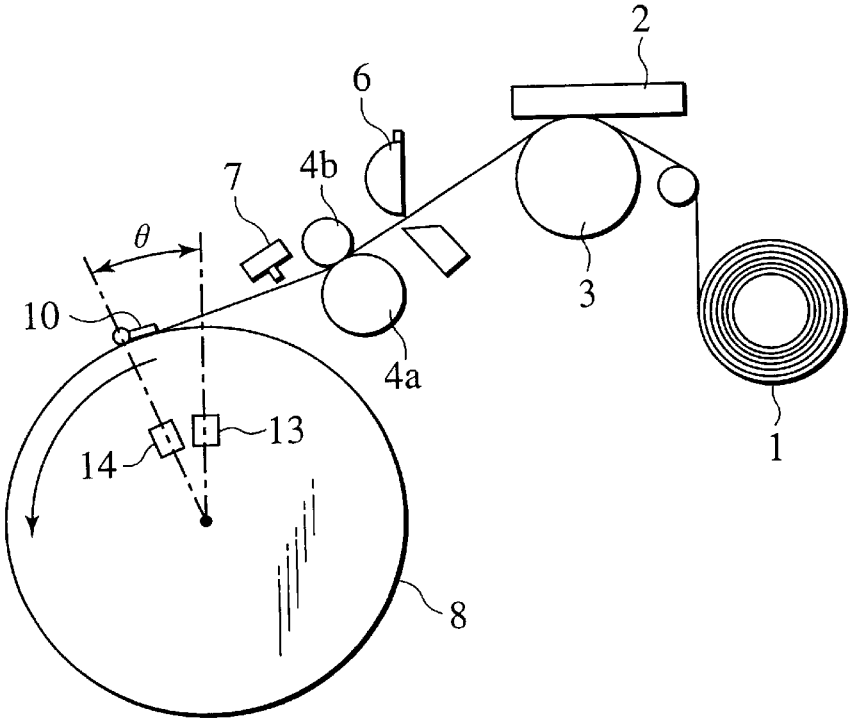
FIG. 16, which shows the first embodiment of the present invention, is a structural diagram showing one process of the stencil making and attaching processes.

Next, as shown in FIG. 16, the drum motor 9 is driven in the forward direction in such a manner that, when the output of the drum re-angle reference position detection sensor 14 is turned on, the driving operation of the drum motor 9 is stopped (steps S4 and S5). Then, the counter for counting the output pulses of the encoder 12 is reset (step S6).

Figure 17:
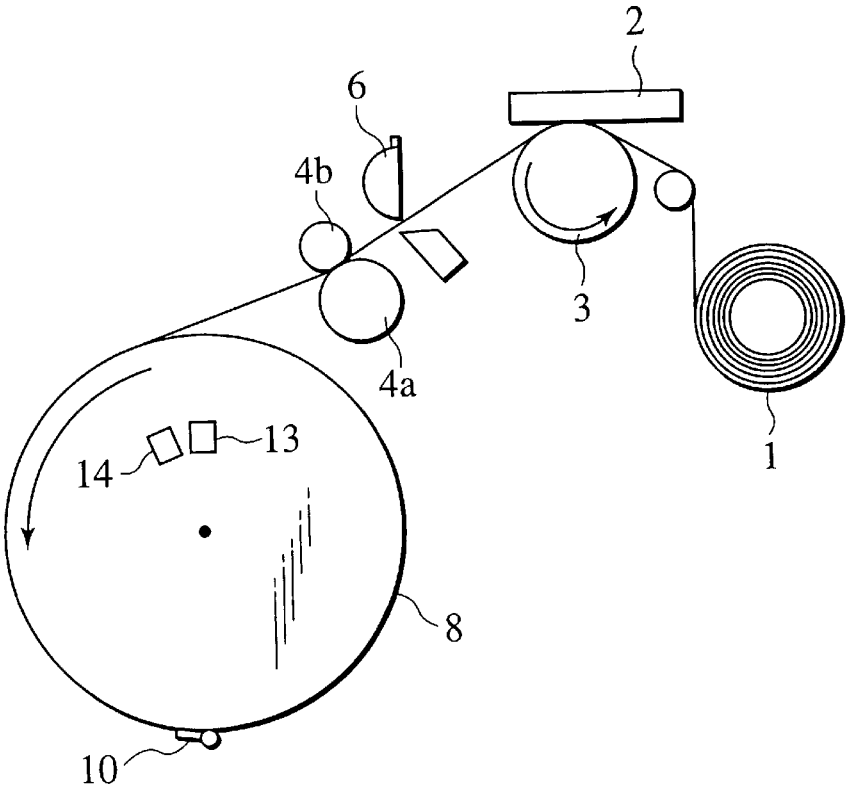
FIG. 17, which shows the first embodiment of the present invention, is a structural diagram showing one process of the stencil making and attaching processes.

Next, as shown in FIG. 17, the drum motor 9 and the stencil motor 5 are driven while being synchronized with each other in the forward direction, and the output pulses of the encoder 12 are counted so that the rotation position of the drum is always monitored (step S7). When the rotation position of the drum 8 has reached a stencil making start rotation position, data writing operation onto the stencil sheet 1 by using the thermal print head 2 (step S8).

When, upon completion of the data writing operation by the thermal print head 2, the rotation position of the drum 8 has reached a stencil sheet cutting position, both of the driving operations of the drum-use motor 9 and the stencil motor 5 are stopped, and the cutter driving section 23 is driven so that the stencil sheet 1 is cut at the stencil sheet cutter section 6 (step S9).

Figure 18:
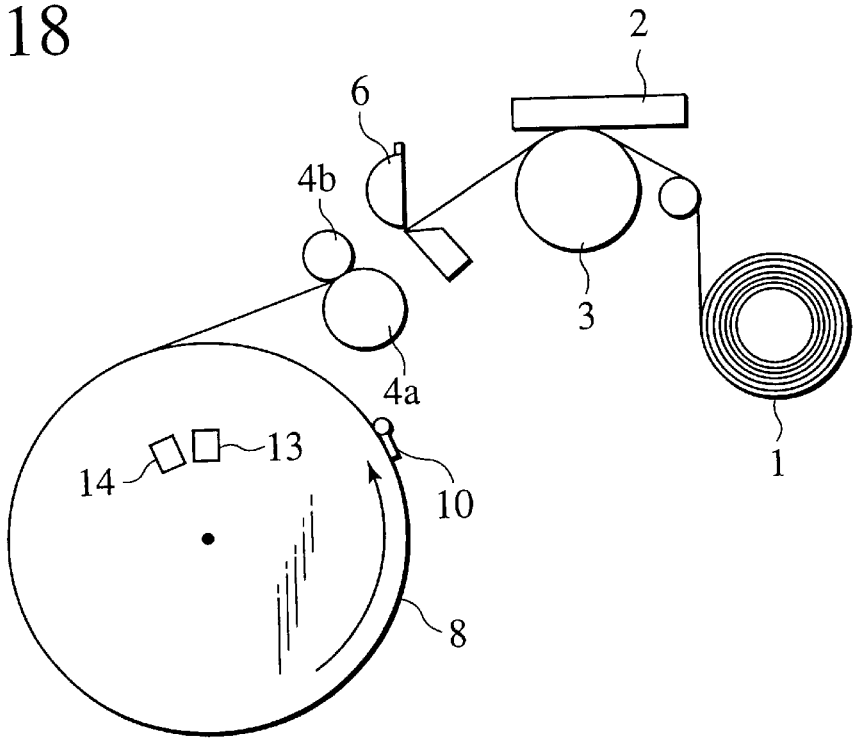
FIG. 18, which shows the first embodiment of the present invention, is a structural diagram showing one process of the stencil making and attaching processes.

Next, as shown in FIG. 18, the drum motor 9 is driven in the forward direction in such a manner that when the output of the drum reference position detection sensor 13 is turned on, the driving operation of the drum motor 9 is stopped (steps S10, S11 and S12). Thus, the printing drum 8 is allowed to return to the drum reference position. Moreover, the stencil motor 5 is driven in the forward direction in such a manner that when the output of the stencil sheet set position detection sensor 7 is turned on, the driving operation of the stencil motor 5 is stopped (steps S13, S14 and S15). Thus, the stencil sheet 1 is located at the stencil sheet set position.

After the above-mentioned processes, the stencil making and attaching operations are completed, and thereafter, a printing operation is carried out. In other words, printing paper 17 is supplied to the gap between the printing drum 8 and the pressure drum 15 in synchronism with the rotations of the printing drum 8 and the pressure drum 15, and the printing paper 17 is conveyed so as to be pressed onto the stencil sheet 1 that has wrapped around the printing drum 8; thus, during this conveying process, ink is transferred onto the printing paper 17 through the pores of the stencil sheet 1 so as to carry out the printing operation.

Figure 19:
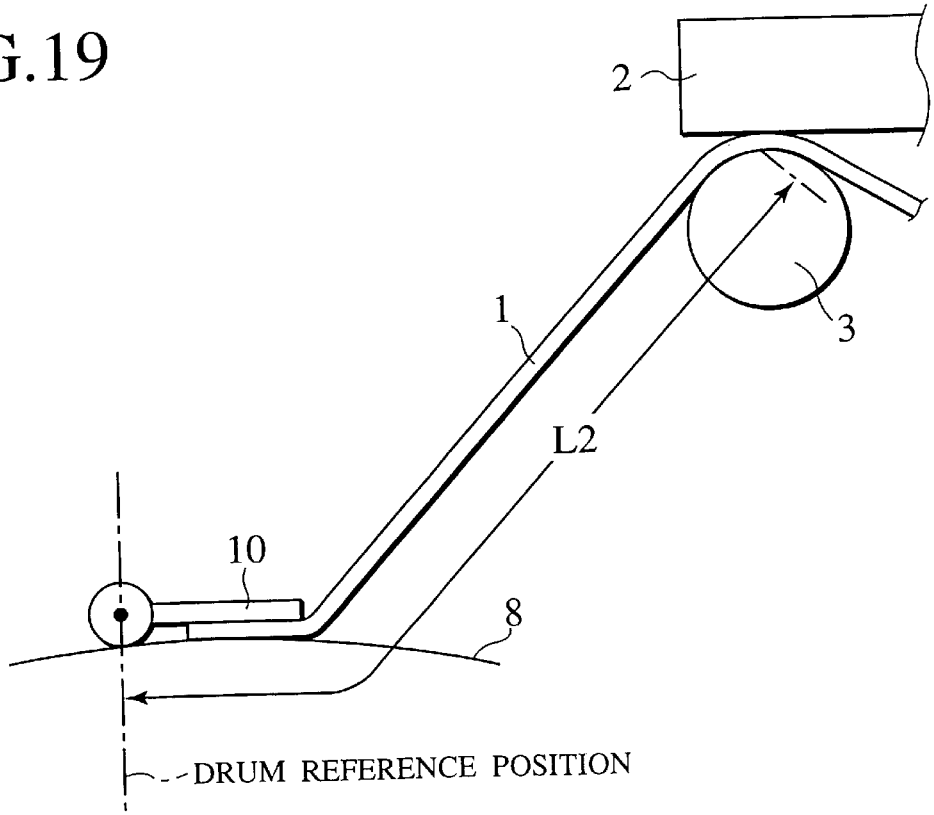
FIG. 19, which shows the first embodiment of the present invention, is a structural diagram of an essential portion showing the positional relationship between a thermal print head and a drum reference position.

In the above-mentioned stencil making and attaching operations, after the leading edge of the stencil sheet 1 has been clamped by the stencil sheet clamp section 10, the stencil sheet 1 is wrapped around and attached to the printing drum 8, and based upon the rotation position of the printing drum 8 at this stencil attaching process, the writing process is carried out on the stencil sheet 1 by using the thermal print head 2 so as to make the stencil; thus, as shown in FIG. 19, an actual distance L2 from the drum reference position of the printing drum 8 to the thermal print head 3 is always maintained constant regardless of variations in the detection of the stencil sheet set position detection sensor 7 and variations in the clamped state due to curled stencil sheet 1, etc. Therefore, it is possible to always set the image-formation start position of the stencil sheet 1 at a regular position with respect to the rotation position of the printing drum 8, and consequently to improve the positional precision of the printing operation.

Moreover, it is not necessary to temporarily stock the stencil sheet 1 that has been subjected to the stencil making process as have been made in conventional methods; thus, since it is not necessary to install the stencil sheet temporary stacker section 106 and convey rollers, etc., it is possible to provide a compact printing device at low costs.

Figure 20:
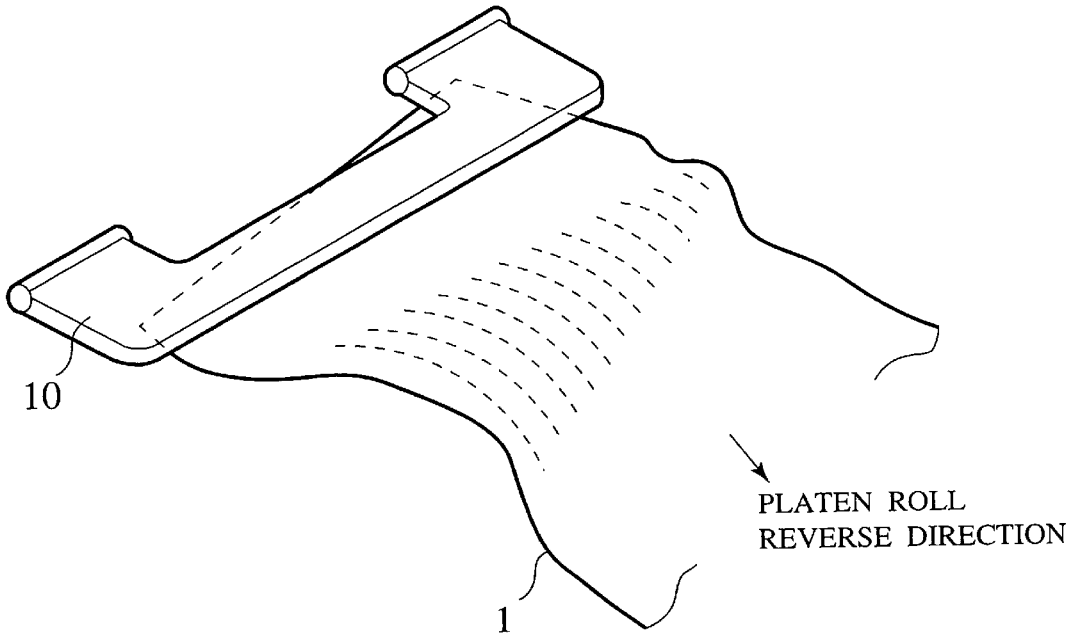
FIG. 20, which shows the first embodiment of the present invention, is a perspective view explaining that it is possible to eliminate variations in amounts of clamping on the right and left sides of a stencil sheet that has been clamped.

Moreover, in the first embodiment, between the clamp process for clamping the stencil sheet 1 by the stencil sheet clamp section 10 and the simultaneous stencil making and attaching processes for wrapping the stencil sheet 1 around the printing drum 8 so as to attach it thereto and for carrying out a writing operation on the stencil sheet 1 by using the thermal print head 3, the stencil sheet tension applying process for applying a tension to the stencil sheet 1 clamped by the stencil sheet clamp section 10 is carried out so that it is possible to eliminate slacking from the stencil sheet 1. Therefore, the positioning of the image-formation start position of the stencil sheet 1 with respect to the rotation position of the printing drum 8 is more precisely performed, and as shown in FIG. 20, even in the case when variations occur in the amounts of clamp between the right and left sides of the stencil sheet 1 at the stencil sheet clamp section 10, the variations in the amounts of clamp on the right and left sides can be eliminated, thereby making it possible to prevent wrinkles at the time of attaching the stencil, and also to prevent an image from being diagonally formed.

Moreover, in the first embodiment, the drum re-angle reference position detection sensor 14 is installed so that, after the stencil sheet 1 has been clamped by the stencil sheet clamping section 10, the rotation position of the printing drum 8 is re-adjusted. Therefore, even in the case of an offset occurring in the detection angle of the printing drum 8 due to the clamping operation, it is possible to ensure stable precision in the detection of the stencil-attaching position. Here, the detection of the re-angle reference detection position may be carried out by the encoder 12.

Second Embodiment

Figure 21:
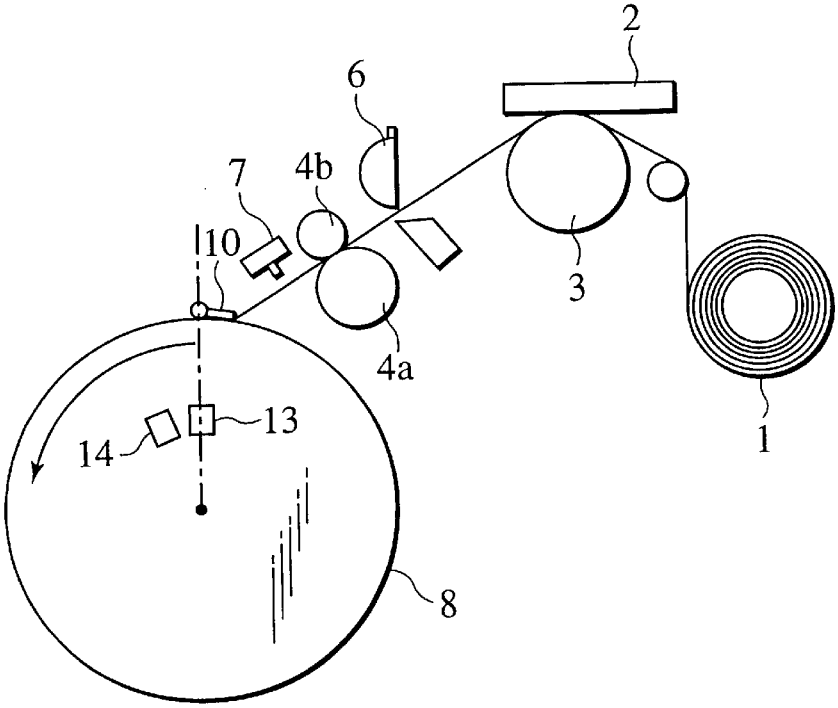
FIG. 21, which shows a second embodiment of the present invention, is a structural diagram showing one process of the stencil making and attaching processes.

FIG. 21, which shows the second embodiment of the present invention, is a structural diagram showing one process of the stencil making and attaching operation.

As illustrated in FIG. 21, the second embodiment is different from the first embodiment in the stencil sheet tension applying process for applying a tension to the stencil sheet 1. In other words, in the second embodiment, the drum motor 9 is driven to an extent corresponding to predetermined pulses so as to rotate the printing drum 8 in the forward direction, with the result that the stencil sheet 1 is pulled in a wrapping direction onto the printing drum 8, and a tension is applied to the stencil sheet 1. The other arrangements are the same as those of the embodiment 1; therefore, the same reference numerals are used in the Figures, and the description thereof is omitted.

The second embodiment also provides the same functions and effects as the first embodiment. Moreover, in the case when the driving system of the printing drum 8 has a structure that is susceptible to backlash, this arrangement makes it possible to prevent errors in the rotation position detection of the printing drum 8 caused by the encoder 12.

Third Embodiment

Figure 22:
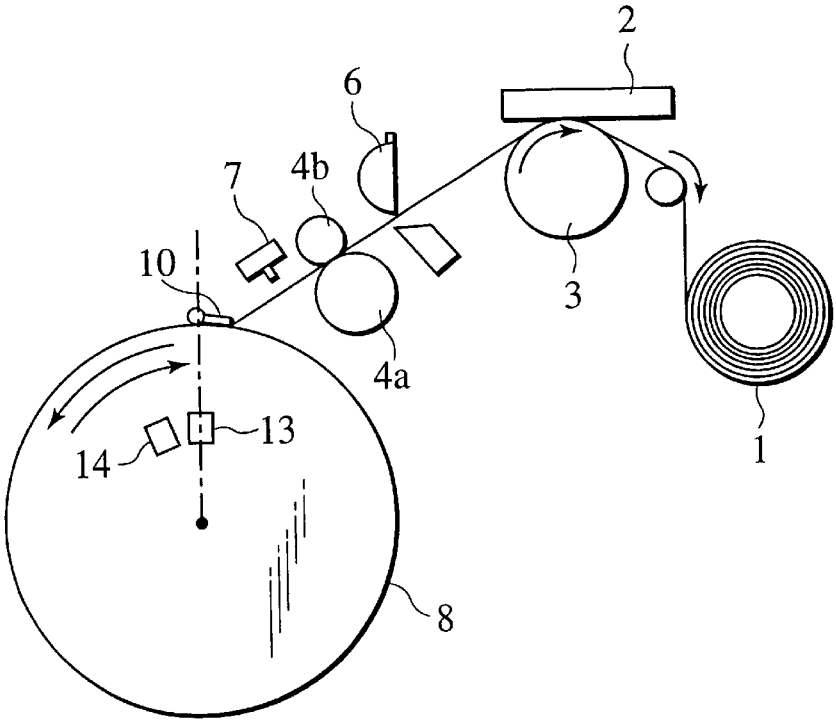
FIG. 22, which shows a third embodiment of the present invention, is a structural diagram showing one process of the stencil making and attaching processes.

FIG. 22, which shows the third embodiment of the present invention, is a structural diagram showing one process of the stencil making and attaching operation.

As illustrated in FIG. 22, the third embodiment is different from the first embodiment in the stencil sheet tension applying process for applying a tension to the stencil sheet 1. In other words, in the third embodiment, the rotation operation of the platen roller 3 and the rotation operation of the printing drum 8 are combined so as to apply a tension to the stencil sheet 1. More specifically, the platen roller 3 is rotated in the reverse direction, and the printing drum 8 is rotated also in the reverse direction; however, this rotation is carried out with a reduced amount of conveyance so as to apply a tension to the stencil sheet 1. Here, another arrangement may be proposed in which, for example, the platen roller 3 is rotated in the reverse direction, while the printing drum 8 is rotated in the forward direction, so that a tension is applied to the stencil sheet 1. The other structures are the same as those of the first embodiment; therefore, the same members are indicated by the same reference numerals and the description thereof is omitted.

The third embodiment makes it possible to provide the same functions and effects as the first embodiment. The completion of the rotation operation of the printing drum 8 is allowed to take place after the completion of the rotation operation of the platen roller 3; therefore, even in the case when the driving system of the printing drum 8 has a structure that is susceptible to backlash, this arrangement makes it possible to prevent errors in the rotation position detection of the printing drum 8 caused by the encoder 12.

In other words, in conventional arrangements, based upon the leading edge position of a stencil sheet, the image formation start position is determined, and based upon the drum rotation position with the leading edge of the stencil sheet being clamped, the printing start position is determined; therefore, in the case when the image formation start position of the stencil sheet itself is not accurate due to curling, etc. of the stencil sheet and variations in the detection of the stencil sheet set position detection sensor 108, or in the case when the clamp position of the stencil sheet with respect to the drum is not accurate, an error occurs in the image formation start position of the stencil sheet with respect to the drum, resulting in an offset in the print position on a sheet of printing paper.

In the present invention, the leading edge of the stencil sheet 1 is clamped by the drum (printing drum 8), and based upon the rotation position of the drum (printing drum 8) with respect to the clamped stencil sheet 1, an image-forming process is carried out; therefore, the image formation start position of the stencil sheet 1 with respect to the rotation position of the drum (printing drum 8) is always set at a regular position, and allowed to coincide with the printing start position that is set based upon the rotation position of the drum (printing drum 8). Thus, it becomes possible to improve the print positional precision with respect to the sheet of printing paper 17.

Other Embodiments

In the above-mentioned embodiments, the stencil sheet is provided as a stencil sheet 1 and the printing head is constituted by a thermal print head, respectively; however, with respect to the stencil sheet, not limited to the stencil sheet, any type of sheet may be adopted as long as a stencil making process is carried out in accordance with a predetermined image, and with respect to the printing head, not limited to the heat-sensitive type, any type of printing head may be used as long as it can perforate a predetermined image.

Here, in accordance with the above-mentioned embodiments, an explanation has been given of a printing device of an inner press system having a printing drum and a pressure drum that are drums, in which a printing pressure is applied by an inner pressing roller from the inside of the printing drum; however, it is needless to say that the present invention can be applied to those devices of an outer press system having a drum and a pressing roller located on the periphery thereof so as to apply a printing pressure from outside.

Various modifications will become possible for those skilled in the art after receiving the teachings of the present disclosure without depending from the scope thereof.

What is claimed is:

1. A stencil making and attaching method of a printing device, which includes: a printing head for writing an image in a stencil sheet, a platen roller that is made in contact with the printing head with the stencil sheet interposed in between, a drum having a stencil sheet clamp section for clamping the leading edge of the stencil sheet, the drum being placed on the downstream side of the printing head and the platen roller in the stencil sheet convey path and drum rotation position detection unit for detecting the rotation position of the drum, comprising the steps of:

rotating the platen roller in the forward direction so as to convey the stencil sheet toward the drum side;

clamping the leading edge of the stencil sheet thus conveyed by the stencil sheet clamp section;

after the clamp process, rotating the platen roller in the forward direction, while rotating the drum in the forward direction so as to wrap the stencil sheet around the drum so as to be attached thereon;

and during this attaching process, detecting the rotation position of the drum by using the drum rotation position detection unit so that the printing head is allowed to perforate the stencil sheet, thereby carrying out a stencil making process.

2. The stencil making and attaching method of a printing device of claim 1, further comprising the step of:

between the clamp process and the simultaneous stencil making and attaching processes, carrying a stencil sheet tension applying process for applying a tension to the stencil sheet clamped by the clamp section.

3. The stencil making and attaching method of a printing device of claim 2, wherein the stencil sheet tension applying process further comprises:

driving the platen roller in a reverse direction that is opposite to the forward direction; and pulling the stencil sheet in a direction so as to be separated from the drum.

4. The stencil making and attaching method of a printing device of claim 2, wherein, in the stencil sheet tension applying process, the drum is rotated in the forward direction so that the stencil sheet is pulled in a direction so as to wrap the stencil sheet along the drum.

5. The stencil making and attaching method of a printing device of claim 2, wherein, in the stencil sheet tension applying process, the rotation operation of the platen roller and the rotation operation of the drum are carried out in a combined manner.

* * * * *